US007476048B2

(12) United States Patent
Prague

(10) Patent No.: US 7,476,048 B2
(45) Date of Patent: Jan. 13, 2009

(54) CAP SEAL FOR A PRODUCT DISPENSING APPLICATOR

(75) Inventor: David Prague, Ringoes, NJ (US)

(73) Assignee: L'Oreal, Paris (FR)

( * ) Notice: Subject to any disclaimer, the term of this patent is extended or adjusted under 35 U.S.C. 154(b) by 133 days.

(21) Appl. No.: 11/516,624

(22) Filed: Sep. 7, 2006

(65) Prior Publication Data

US 2008/0063464 A1 Mar. 13, 2008

(51) Int. Cl.
*B05C 11/00* (2006.01)
*B65D 41/16* (2006.01)

(52) U.S. Cl. ..... 401/262; 401/266; 401/265; 215/320; 215/321

(58) Field of Classification Search ..... 401/261–266; 215/320, 321
See application file for complete search history.

(56) References Cited

U.S. PATENT DOCUMENTS 3,236,417 A * 2/1966 Linton ..... 222/92
4,002,182 A * 1/1977 Michel ..... 401/263
4,915,268 A * 4/1990 Lay et al. ..... 222/498
5,772,347 A 6/1998 Gueret
6,286,731 B1 9/2001 Lillelund et al.
6,513,536 B1 2/2003 Demellier et al.
6,939,072 B2 9/2005 Thiebaut

FOREIGN PATENT DOCUMENTS

FR 1 489 494 7/1967
FR 2 797 754 3/2001

OTHER PUBLICATIONS

U.S. Appl. No. 11/516,625, filed Sep. 7, 2006, Prague et al.
U.S. Appl. No. 11/756,111, filed May 31, 2007, Prague.

* cited by examiner

*Primary Examiner*—David J Walczak
(74) *Attorney, Agent, or Firm*—Oblon, Spivak, McClelland, Maier & Neustadt, P.C.

(57) ABSTRACT

A device for containing and dispensing a product includes a housing configured to contain the product having at least one aperture formed in one end of the housing. A sealing member is provided separately from the housing and includes at least one projection on a first surface of the sealing member, wherein the at least one projection is configured to be engaged with the at least one aperture to prevent the product from being discharged from the housing through the at least one aperture.

19 Claims, 2 Drawing Sheets

CAP SEAL FOR A PRODUCT DISPENSING APPLICATOR

BACKGROUND

1. Field of the Invention

This invention is directed to a cap seal for an applicator configured to hold and dispense a product from the applicator.

2. Description of the Related Art

Cosmetic products have been sold in applicators having a hollow portion, from which the product is dispensed through the hollow portion by a dispensing mechanism controlled by the user. One example of this type of applicator is a liquid lip dispensing pen. When not in use, a cover can be placed over the applicator to enclose the dispensing end of the applicator and thereby reduce undesired dispensing as well as to reduce scratches or other damage to the applicator.

However, merely providing a cover over the applicator will not necessarily prevent the product from being dispensed from the applicator. For example, if the product has a low viscosity, the product can flow through the dispensing holes contained in the applicator and become trapped in the cover. As such, when the user removes the cover, the product could spill out onto the user, their clothes, the dispensing end of the applicator, or other undesirable locations. In addition to losing at least a portion of the product due to the spill, the remainder of the product could dry out due to exposure with the environment. This of course, can lead to an unacceptable product for the user.

SUMMARY OF THE INVENTION

As discussed above, a dispensing pen that can dispense a product through a series of holes can have product loss through the holes. Exemplary embodiments of this invention provide an apparatus that reduces or eliminates product that can flow through dispensing holes.

Accordingly, an object of examples of embodiments of the present invention is to provide a container having a cap which addresses and/or overcomes the problems residing in the background art. According to an example disclosed herein, a cap seal is provided that reduces or prevents leakage of product from the applicator and creates an air-tight seal. By way of example, the cap seal can be a multi-seal insert.

According to an example, a cap is provided that includes at least one projection to engage apertures formed at a discharging end of the product dispensing housing. By way of example, the cap can be configured to provide a seal that can accommodate varying dimensions of the discharging end of the applicator to maintain an air-tight seal. According to an example, a surface of the seal can be flexible, for example by providing a thinning of the material in and/or around a contoured surface of a seal, and/or providing a yieldable material. Such an arrangement can more reliably ensure a sealing engagement of the seal (and protrusion associated therewith) with the applicator. In addition, such an arrangement can advantageously accommodate for manufacturing variations or tolerances in the applicator, the seal and/or the cap. The seal surface can additionally, or alternatively, be a contoured surface configured to dynamically flex in order to substantially match a surface of the applicator.

By way of example, at least one projection is provided on the sealing surface and are positioned to line up and engage at least one aperture provided in the dispensing end of the housing.

According to an example, guiding devices are provided at one or more areas of the cap and/or seal insert. In addition, guides can be provided on the dispensing housing to facilitate alignment of the projections with the apertures when the cap is mounted on the dispensing device.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The invention will be better understood from reading the description which follows and from examining the accompanying figures. These are provided solely as nonlimiting examples of the invention. In the drawings.

DETAILED DESCRIPTION OF THE PREFERRED EMBODIMENTS

Figure 1:
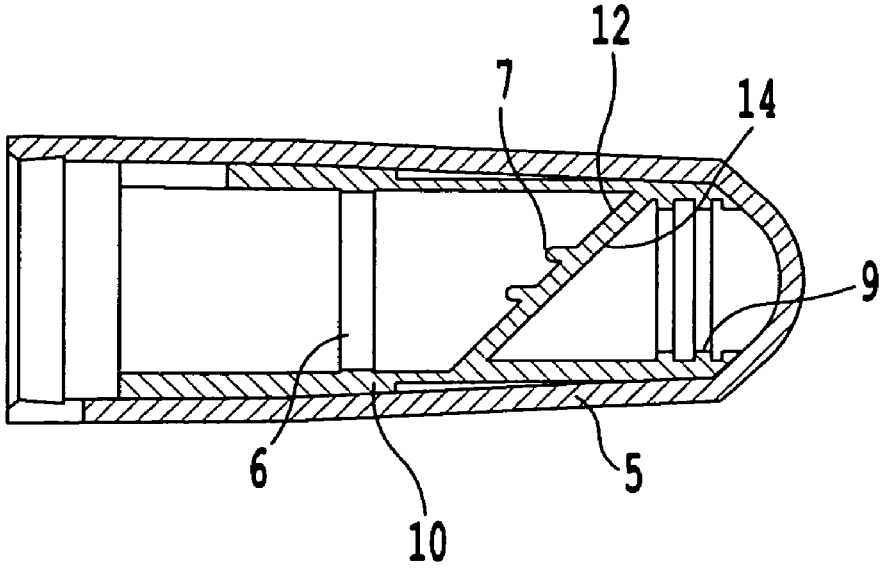
FIG. 1 is a schematic cross-sectional view showing the cap seal insert in the cap according to an example of the invention.

Reference will now be made in detail to the present preferred embodiments of the invention, examples of which are illustrated in the accompanying drawings. Wherever possible, the same reference characters will be used throughout the drawings to refer to the same or like parts.

FIG. 1 illustrates a cross-sectional view of an example of a dynamic cap seal according to an example of the invention. The cap seal insert 10 can be configured to fit securely into and connect with a covering portion or cap 5 or any other similar type structure. In order to fit with cap 5, an end portion 9 of the cap insert 10 can be any shape, for example cylindrical, or size and can have an open top or be completely enclosed, depending on, for example, design and aesthetic considerations. It should be appreciated that the cap seal insert 10 can be in the shape of a cup and can be configured to be inserted into cap 5 as discussed above, or can be formed integrally with the cap 5 during manufacturing. Thus, while the cap seal is shown as an insert, it can be formed with the cap as one piece.

Figure 2:
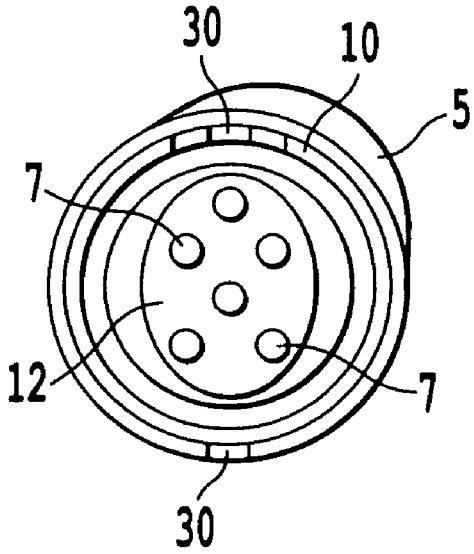
FIG. 2 is a schematic view showing an interior portion of the cap and cap seal insert according to an example of the invention.

The cap seal insert 10 includes a sealing member or sealing surface 12 that can extend from the side wall surfaces of the insert 10 to enclose a top portion of the insert 10. The sealing surface 12 can be any size or shape, for example circular or oval. Preferably, the surface 12 extends completely across the circumference of the insert 10. The sealing surface 12 can also only extend across only a portion of the insert 10 and can be located at any position along the length of the insert 10. Further, the sealing surface 12 can be formed at an angle with respect to side surfaces or side walls of the insert 10, such as for example, at an oblique angle with respect to the side surfaces. However, it should be appreciated that the sealing surface 12 can be provided at any desirable angle at any location along a length of the cap insert 10. For example, as shown in FIG. 2, if the cap insert 10 is formed in a substantially circular shape and the sealing surface 12 extends at an angle across a diameter of the insert 10, then the sealing surface 12 will be formed in a substantially oval shape to sufficiently extend across the entire interior area of the insert 10. Accordingly, because the cap seal insert 10 can be any desirable shape, for example a circle, square, pentagon, or oval, the sealing surface 12 can likewise be any shape in order to enclose the interior area of the cap insert 10.

Figure 4:
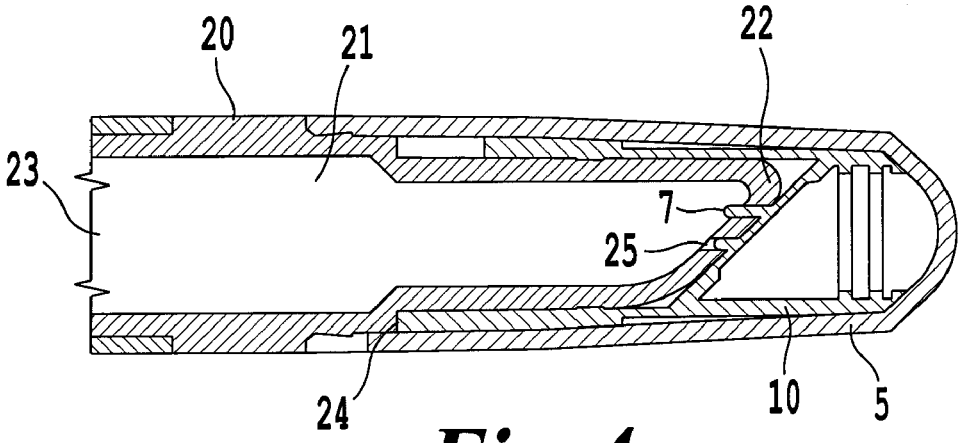
FIG. 4 is a schematic showing the applicator removably secured to the seal insert according to an example of an embodiment of the invention.

As best shown in FIG. 4, the sealing surface 12 of the cap seal insert 10 is configured to at least substantially match a shape of a nose piece 22. Generally, the nose piece 22 could have a flat or contoured surface, for example, a surface extending transverse to a flow direction of the product contained in the applicator 20. Accordingly, it should be appreciated that the area of the sealing surface 12 could be contoured or flat or have any other desirable characteristics as long at the shape substantially matches the corresponding shape of the mating surface of the nose piece 22. Further, it should be appreciated that the different cap seal inserts 10 can be configured to be connectible to and removable from the cap 5. For example, the different cap inserts 10 can have varying shapes, sizes, number and/or size of projections, material makeup, or any other characteristic in order to match with the characteristics of the nose piece 22. Accordingly, the user can remove and replace the insert 10 as desired.

By way of example, the sealing surface 12 can include a dynamic flex area 14 made from material having a thinner area that the material of surrounding portions of the sealing surface and/or insert 10. That is, a cross-sectional area of the dynamic flex area 14 can be smaller than an area of the cap seal insert 10 side walls. Accordingly, the dynamic flex area 14 can include part or all of the sealing surface 12 and can be made of the same, similar, or different material than the sealing surface 12. It should be appreciated that the thinning of the material and thus, providing a flex area 14, could be in areas other than the sealing surface 12 in order to allow flexing and to provide desirable contact between various components of the device. Selection of a proper material, such as for example plastic, allows for the flexing and movement of the flex area 14. In this way, the flex area 14 can contact portions of the device, such as the nosepiece 22, in order to maintain a desirable amount contact and pressure between those components. Further, providing the dynamic flexing area 14 with the sealing surface 12 can compensate for tolerance variations that can arise due to production molds and various other factors and can help maintain contact between the surface 12 and for example, the nosepiece 22.

Figure 3:
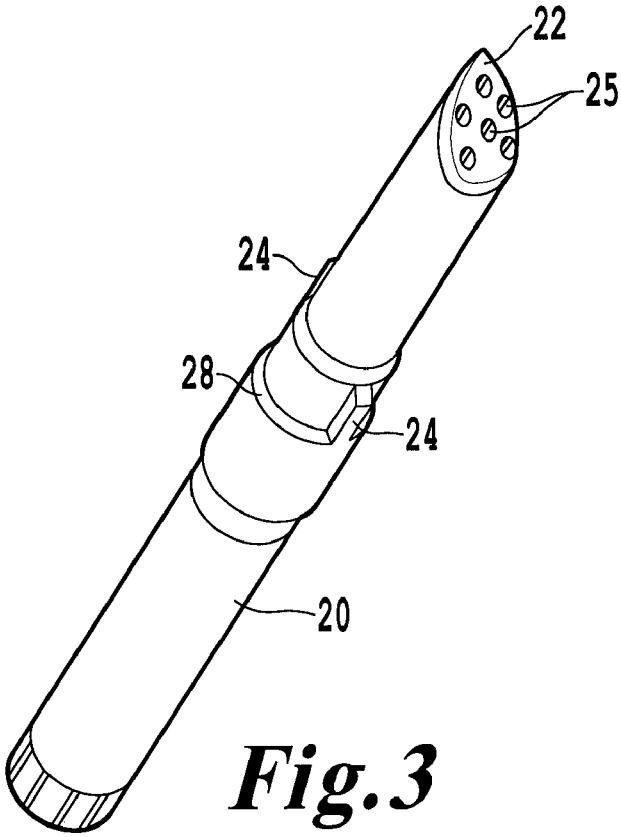
FIG. 3 is a schematic side view showing an applicator according to an example of the invention.

As shown in FIGS. 3 and 4, an applicator 20 of examples of embodiments of the invention, is a generally hollow structure with side walls with an end forming a nosepiece 22. For example, the applicator 20 can be a cylindrical structure or have any other desirable shape. The hollow interior portion of the applicator 20 can be a housing, reservoir or containing area 21 for the product to be stored and discharged from the applicator 20 through the nosepiece 22. The product can be for example, a lip, a skin, or other type of dermatological product and can be in the form of for example, a liquid, a gel, a cream, powder and can have the consistency of, for example, a solid, pasty, semi-soft, or flowable product. The product can be introduced into the hollow portion through opening 23 formed at an end opposite to the nosepiece 22. Associated with the applicator 20 is a discharge device, not shown, located at or near an opposite end of the applicator in order to facilitate the movement of the product out of the applicator 20 and through the discharge apertures 25 located at the nosepiece 22. It should be appreciated that the discharge device can be any known or later developed device capable of moving product through a housing and dispensing the product to the user.

When the applicator 20 and cap 5 are connected together, the nose piece 22 and at least a portion of the remainder of the applicator 20 are configured to fit into the interior of cap 5. As an example, a ridge 28 is formed with the applicator 20 and can contact a side wall of the cap 5. Further, a sealing bead 6 can be provided with the cap 5 or cap seal insert 10. The sealing bead 6 can be configured to surround at least a portion of the applicator 20 in order to form an airtight seal. By way of example, the sealing bead 6 can be a raised portion of the cap 5 and/or cap seal 10 to engage an outside surface of the applicator 20. The airtight seal can be beneficial when the product contained in the applicator 20 is a product that might evaporate, dry-out, or otherwise would have characteristics change if not for an airtight seal.

A side wall area of the applicator 20, for example at a top side of ridge 28, can include at least one projection or protruding portion 24. The at least one protruding portion 24 is configured to engage with a corresponding number of protrusion receiving portions 30 formed in the seal insert 10 and/or cap 5. Similarly, at least one additional protruding portion 24 can be located between the ridge 28 and the nose piece 22 configured to engage receiving portions or guide 30 formed in the cap seal insert 10. The protruding portions 24 and receiving portion 30 can guide the mating surfaces of cap 5 and cap seal insert 10 to an appropriate connection with the applicator 20. Thus, the protruding portions 24 and receiving portions 30 can have any desirable shape, such as, a square, rectangle, triangle, or can be in the form of a clasp or snap or similar structure in order to facilitate the connection there between. It should be understood that the at least one protruding portion 24 and receiving portion 30 can be any type of structure capable of guiding and/or securely connecting the applicator 20 with the cap 5. The guiding portions of the cap 5 and applicator could also be in the form of a marking or other visible display aiding the user with connecting the cap 5 and applicator 20. In this way, the applicator 20 can be connected to the seal insert 10 and/or the cap 5 in an appropriate and desirable position to, for example, align projections and apertures discussed in more detail below and to prevent the applicator 20 and cap 5 from twisting or disconnecting from one another.

According to an example of the invention, at least one projection 7 can be formed on the sealing surface 12 of the cap seal insert 10. The at least one projection 7 is positioned to line up with a corresponding one of the at least one apertures 25 formed in the nosepiece 22 in order to help reduce or prevent migration of product out of the applicator 20 through the nosepiece 22. It should be appreciated that any number of projections 7 having any desirable shape and size at any location can be formed on the sealing surface 12. For example, a single aperture 25 can be formed at or near a center portion of the nose piece 22. The single aperture 25 can have a smaller opening than the product containing cavity of the applicator 20. As such, an equal number of apertures 25 can be formed having similar characteristics so that the projections 7 can enter the apertures 25. Accordingly, at an undesirable time, for example, when a temperature of the package in at an elevated level causing the product viscosity to be lower, the at least one projection 7 of the sealing surface 12 engaging the at least one aperture 25 of the nosepiece 22, can reduce or stop the product flow from leaving the applicator 20.

According to one or more embodiments of the invention, when the cap 5 and applicator 20 are connected together using the aide of the at least one protruding portion 24 and the at least one protrusion receiving portions 30, the projections 7 can engage the apertures 25. For example, the projections 7 can extend partially through the apertures 25 to effectively close off the aperture 25 and reduce or prevent product from dispensing through the aperture 25. According to an example of the invention, the at least one projection 7 can extend completely through the aperture 25 with at least a tip end of the projection 7 entering into the hollow interior portion of the applicator 20 containing the product. Further, in accordance with another example of the invention, the at least one projection 7 can be configured to engage an outside end or exit of the aperture 25 at the outer surface of the nosepiece 22. That is, it is not necessary for the projection 7 to enter the aperture 25 to seal the aperture 25. Thus, it should be appreciated that, in accordance with an example of the invention, the at least one projection 7 can be configured to extend any length of the aperture 25 from an outside end to completely though the aperture 25 in order to help reduce or prevent the migration of the product out of the nose piece 22.

Accordingly, one or more embodiments of this invention described above, provide for a cap seal device configured to reduce or stop product flow as so desired, for example, during a filling of the applicator with product and while the package is stored by the user. Further, providing a seal to cover the dispensing holes reduces or eliminates the product drying out and becoming otherwise unacceptable for use by the user. As such, liquid dispensing pens that dispense a product through a series of holes can reduce or prevent product loss through the holes in accordance with various examples of the invention While exemplary embodiments of this invention have been described in conjunction with the embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for containing and dispensing a product, comprising:

a housing configured to contain the product;

at least one aperture formed in one end of the housing;

a sealing member provided separately from the housing; and at least one projection formed on a first surface of the sealing member, wherein the at least one projection is configured to be engaged with the at least one aperture to prevent the product from being discharged from the housing through the at least one aperture, wherein said first surface includes a plurality of projections, wherein said housing includes a housing surface having a plurality of apertures, and wherein said plurality of projections engage said plurality of apertures when said sealing member is mounted on said housing, wherein the housing includes a longitudinal axis, and wherein said housing surface extends at a constant oblique angle with respect to said longitudinal axis, wherein the first surface extends substantially parallel to said housing surface.

2. The device according to claim 1, wherein the sealing member includes a cylindrical portion, and wherein the first surface extends across the cylindrical portion to enclose at least a portion of the sealing member.

3. The device according to claim 2, further comprising:

a covering portion, wherein the covering portion and sealing member are secured together forming a cap.

4. The device according to claim 3, wherein the cap is configured to receive at least a portion of the housing.

5. The device according to claim 1, wherein a first portion of the first surface includes a first area that is thinner than a second area of the sealing member.

6. The device according to claim 1, wherein the first surface includes an area that is thinner than at least one side wall of the sealing member.

7. A device according to claim 1, wherein the sealing member is associated with a cap, wherein said cap is mountable on said housing.

8. A device according to claim 7, wherein the housing includes a protrusion which is received in a guide of the cap upon mounting of the cap on the housing, and wherein the protrusion and guide align the cap with respect to said housing such that said projection of said first surface enters the aperture of said housing when said cap is mounted on said housing.

9. A device according to claim 1, wherein said housing contains a flowable product which flows through said at least one aperture.

10. A device according to claim 9, wherein said housing surface extends transverse to a direction of flow of said product.

11. A device according to claim 1, wherein said sealing member is an insert in a cap, which is mountable on said housing.

12. A device according to claim 11, wherein said insert includes a guide which receives a protrusion of said housing when said cap is mounted on said housing to align said housing with respect to said insert such that said projection engages said aperture when said cap is mounted on said housing.

13. A device according to claim 12, wherein said housing includes a further projection which is received in a guide formed in said cap.

14. A device according to claim 1, wherein said housing includes a flowable cosmetic product.

15. A device according to claim 14, wherein said flowable cosmetic product is a lip make-up.

16. A device according to claim 1, wherein the sealing member is in the form of a cup, wherein said housing includes a cylindrical portion which at least partially protrudes into said cup, wherein a housing surface partially closes an end of said cylindrical portion and said at least one aperture extends through said housing surface, and further wherein said first surface extends across a portion of said cup.

17. A device according to claim 16, wherein said cup includes a sealing bead on an internal surface thereof which engages an outer peripheral wall of said cylindrical portion of said housing.

18. The device according to claim 1, wherein at least one of the plurality of projections extend at least partially through the plurality of apertures to prevent product from escaping through the apertures.

19. The device according to claim 1, wherein at least one of the plurality of projections extend completely through the plurality of apertures to prevent product from escaping through the apertures.

* * * * *